US005699748A

United States Patent [19]

Linskey, Jr. et al.

[11] Patent Number: 5,699,748

[45] Date of Patent: Dec. 23, 1997

[54] LINE HANDLING DEVICE FOR POSITIONING AND HANDLING OF MOORING LINES

[76] Inventors: Edward Linskey, Jr., 3030 NW. 23 rd Ave., Ft. Lauderdale, Fla. 33311; Robert V. Daigle, 762 NE. 42nd St., Pompano Beach, Fla. 33069

[21] Appl. No.: 796,533

[22] Filed: Feb. 6, 1997

[51] Int. Cl.[6] ..... B63B 21/56

[52] U.S. Cl. ..... 114/221 R; 294/19.1; 119/804; 114/230

[58] Field of Search ..... 114/221 R, 230; 294/19.1; 119/801–804

[56] References Cited

U.S. PATENT DOCUMENTS

| | | | |
|---|---|---|---|
| 3,993,013 | 11/1976 | Nunziato et al. | 114/221 |
| 4,004,539 | 1/1977 | Wesson | 114/221 |
| 5,009,181 | 4/1991 | Upchurch | 114/221 |

*Primary Examiner*—Jesus D. Sotelo

*Attorney, Agent, or Firm*—McHale & Slavin

[57] ABSTRACT

The present invention is a line handling device designed to facilitate positioning and handling of a mooring or docking line during a boat docking operation. The device employs a pair of arc-shaped spreader arms connected to an extendable pole. Each arm has a sleeve shaped to fit the pole. A fastening bolt passes through each sleeve, extending through the pole to secure the spreader arms to the distal end of the pole. A plurality of support tabs extend from an outer wall of each spreader arm and retaining posts extend orthogonally from each tab. While attached to the handle, the spreader arms form a U-shaped frame which is used to shape and hold the looped end of a mooring line so that it may be placed around a piling or dock cleat. Withdrawing the device away from the piling or cleat leaves the looped-end of the mooring line securely in place. Each arm includes a plurality of apertures or receiving holes sized to frictionally engage stacking pins. To store the device, the arms are removed from the pole and stacked so that pins in one arm are aligned with and penetrate corresponding apertures of the other arm.

13 Claims, 2 Drawing Sheets

LINE HANDLING DEVICE FOR POSITIONING AND HANDLING OF MOORING LINES

FIELD OF THE INVENTION

This invention relates to nautical line handling devices, and more particularly to a multi-component, easily-stored device for handling and positioning mooring lines.

BACKGROUND OF THE INVENTION

In the hands of a capable captain, under normal conditions, a pleasure craft traveling at moderate speeds in open water is relatively safe from damage due to collision. Likewise, a boat which has been successfully secured to a dock or piling is also relatively safe, barring unforeseen circumstances, from damage due to collision. However, as a boat approaches a dock or piling and reduces its speed, it faces an increased risk of collision until it is securely docked. During the docking process, bringing a boat quickly to a controlled stop reduces the likelihood of collision with the dock or piling. As a result, time is of the essence when docking a boat.

Often, a mooring line is used to control and secure a boat during docking. Usually, one end of the line is looped, and this looped end is placed around a dock piling or dock cleat. Depending upon a boat's size, several lines may be needed in order to securely stop and hold a boat in position. Often, it is difficult to place the looped end of the line around a piling or cleat. Some boaters attempt to throw the loop, lasso-style, while others rely on a second crew member for assistance. Still other boaters employ a line handling device to place the looped end of the mooring line around a piling or cleat. Unfortunately, current line handling devices have many shortcomings.

For example, U.S. Pat. No. 3,841,685 discloses a line handling device designed to secure a mooring line to a piling. The device uses a slotted circle to lower a loop of line around a piling. Unfortunately, this device is not adjustable and, therefore, only works on pilings which fit within its preset dimensions.

Some line handling devices, like U.S. Pat. No. 4,004,539 were designed with large frames to accommodate pilings of various sizes. These line handling devices were found to work with a wide variety of pilings, but they also created new problems: they were hard to store and required two-handed control of the device. This two-handed line handling operation thereby reduced the boater's ability to use his or her hands to control the boat during docking.

Accordingly, one-handed line handling devices were developed. For example, U.S. Pat. No. 5,009,181 discloses a line handling device which places line-stiffening members onto the looped end of a mooring line. This device allows one-handed placement of a line, but poses preparation problems. For example, based on weather or water currents, different numbers of mooring lines may be required during different docking sessions. Devices which require mooring line modification are not suitable for dealing with last minute changes in conditions. This type of device is essentially useless if an extra line is needed unexpectedly.

Accordingly, what is needed in the art is a line handling device that may be quickly, conveniently, and effectively used with one hand. The device should also accommodate a variety of dock pilings or dock cleats, and should also be is easy to store.

SUMMARY OF THE INVENTION

The present invention is a line handling device used to facilitate the handling of a mooring line when a user is securing a boat to a dock or piling. The device employs a pair of arc-shaped spreader arms which are connected to one end of an extendable pole. When attached to the handle, the arms form a three-sided, U-shaped frame.

Line-support tabs extend outward from the spreader arms and provide support for the loop end of a mooring line which has been draped around the outside contours of the device. Retaining posts extend orthogonally from the tabs and help keep the loop in place.

The line handling device is used during the securing of a boat to help a user place and secure the loop end of a mooring line around a piling or dock cleat. First, the user adjusts the loop end of the mooring line to create a loop having roughly the same outer dimensions as the U-shaped frame of the device. Next, the user rests the loop on the support tabs, positioning the line between the retaining posts and the outer wall of the spreader arms. This shapes the loop so that it may be lowered around a piling or dock cleat which is within reach of the extendable pole. The user then lowers the device-supported loop end of the mooring line around the cleat or piling. Using a horizontal motion, the user pulls the device away from the cleat or piling. As the device is drawn towards the user, the mooring line's adjustable loop will engage the cleat or piling and become separated from the line handling device. The loop may then be drawn tight about the cleat or piling by pulling on the mooring line's non-looped end.

After use, the line handling device may be broken down for storage by removing the spreader arms from the extendable pole. Each arm has holes through which a stacking pin may be placed. To store the device, the arms are stacked, one on top of the other, with the stacking pins penetrating corresponding receiving holes.

Accordingly, it is an object of the present invention to provide a line handling device that facilitates the handling and securing of a mooring line, without requiring special preparation or alteration of the line.

Yet another object of the present invention is to provide a line handling device that facilitates the handling and securing of a mooring line, the device being self-contained and having no components which separate from the device during use.

A further object of the present invention is to provide a line handling device that facilitates the handling and securing of a mooring line, the device being modular and easy to store.

Still another object of the present invention is to provide a line handling device used to facilitate the handling and securing of a mooring line, the device being capable of use with several unaltered mooring lines during a single mooring operation.

Yet a further object of the present invention is to provide a line handling device used to facilitate the handling and securing of a mooring line, the device being buoyant, able to float if dropped water.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
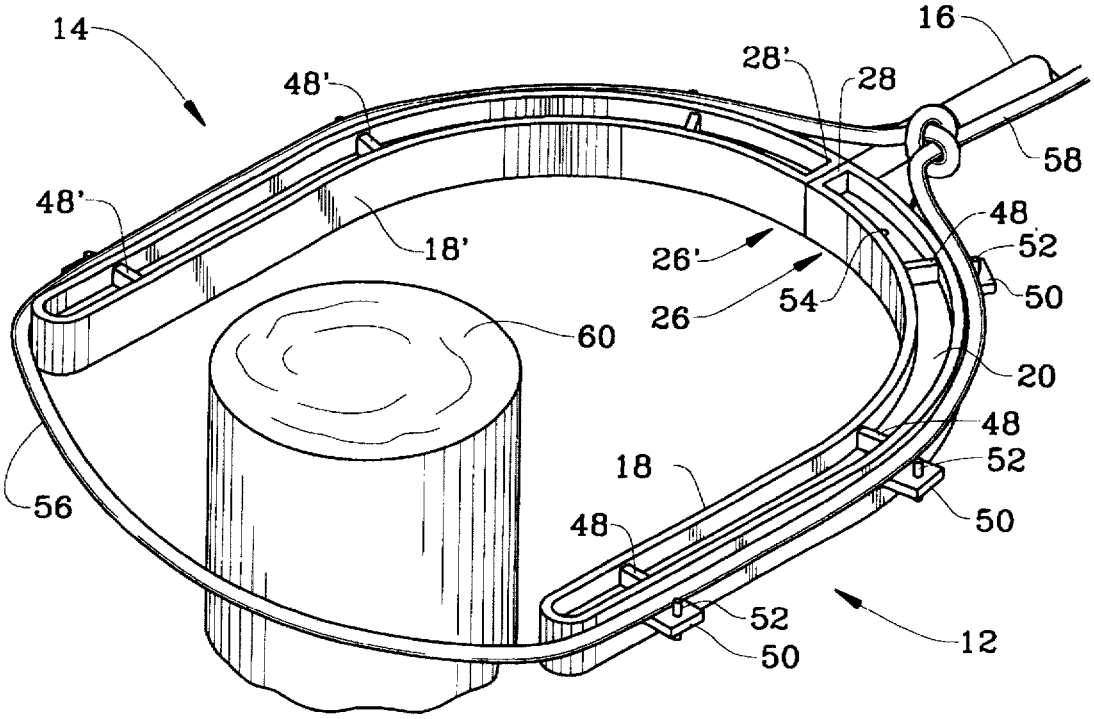
FIG. 1 is a perspective view showing the present invention being used to place a mooring line around a piling.
Figure 2:
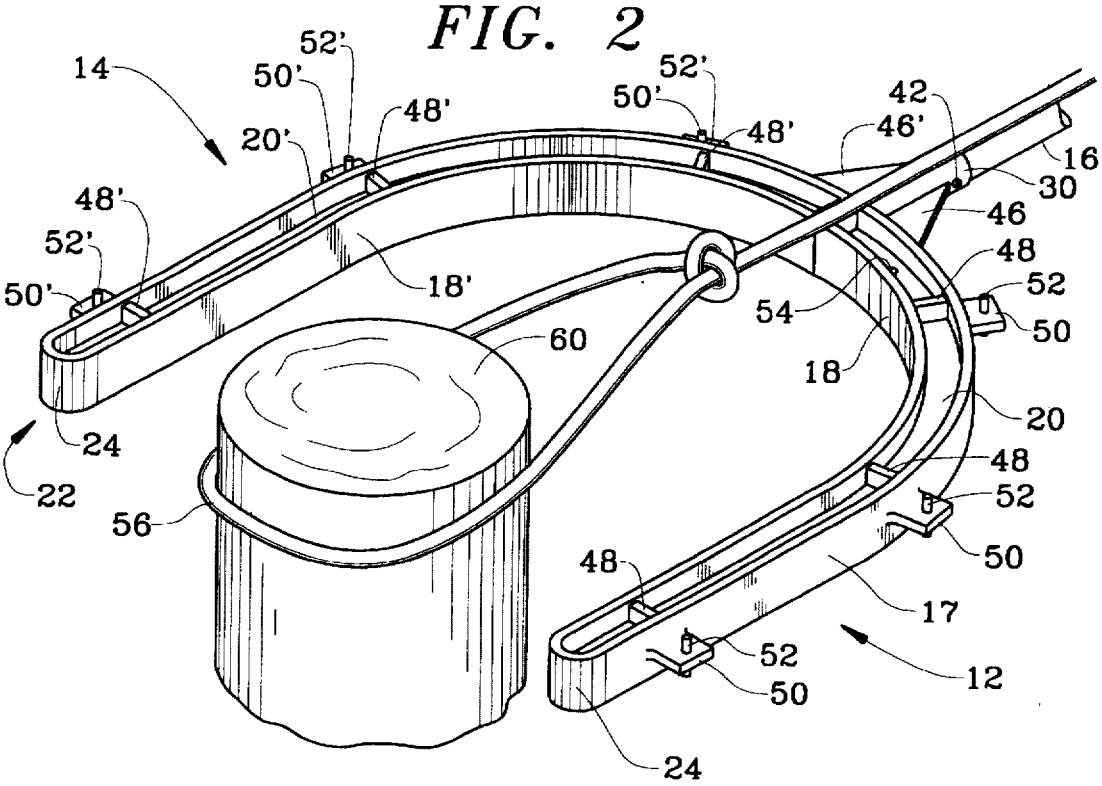
FIG. 2 is a perspective view showing the present invention being used to secure a mooring line around a piling.

Reference is now made to FIGS. 1 and 2, wherein the line handling device 10 of the present invention is shown. The device 10 facilitates the handling and securing of a mooring line 56 to a piling 60. The device 10 comprises a pair of arc-shaped spreader arms 12, 14 which are connected to an extendable pole 16.

Figure 3:
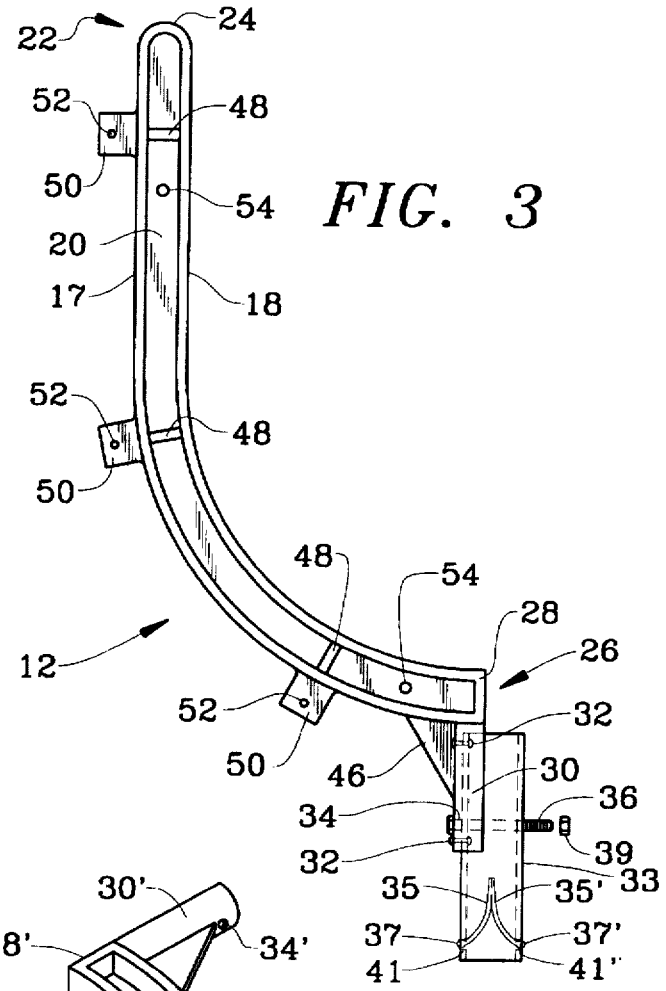
FIG. 3 is an overhead view of one spreader arm of the present invention.

Now referring to FIG. 3, first spreader arm 12 is defined by an outer wall 17 and an inner wall 18 which are spaced apart by a spacing wall 20. The spacing wall 20 extends orthogonally between the outer wall 17 and the inner wall 18, which are parallel to each other. First spreader arm 12 has a free end 22, which includes an arched free end wall 24 and an attachment end 26 characterized by a flat attachment wall 28.

Referring also again to FIGS. 1 and 2, the second spreader arm 14 is identical in form to the first spreader arm and is defined by an outer wall 17' and an inner wall 18' which are spaced apart by a spacing wall 20'. The spacing wall 20' extends orthogonally between the outer wall 17' and the inner wall 18', which are parallel to each other. Second spreader arm 14 has a free end 22', which is characterized by an arched free end wall 24' and an attachment end 26' characterized by a flat attachment wall 28'. The attachment end walls 28, 28' are shaped so that the attachment end wall 28 of the first spreader arm 12 lies flat against the attachment end wall 28' of the second spreader arm 14. As such, the spreader arm 14 forms a mirror image of spreader arm 12. Accordingly, each arm may be formed from the same mold to reduce manufacturing costs.

Near the attachment end 26 of spreader arm 12, an attachment sleeve 30 extends orthogonally from the outer wall 18. Attachment sleeve 30 has a bolt aperture 34 sized to accept a fastening bolt 36. Near the attachment end 26' of spreader arm 14, an attachment sleeve 30' extends orthogonally from outer wall 18' of the arm 14. Attachment sleeve 30' has a bolt aperture 34' sized to accept fastening bolt 36. The distal end 38 of the extendable pole 16 has a bolt bore (not shown, covered by sleeves 30, 30') which is also sized to accept the fastening bolt 36. A first reinforcing flange 46 extends between the attachment sleeve 30 of the first spreader arm 12. A second reinforcement flange 46' extends between the attachment sleeve 30' and the wall 17' of the second spreader arm In preparation for use of the device 10, attachment end wall 28 is placed against attachment end wall 28'. When so positioned, the spreader arms 12, 14 cooperate to form a substantially U-shaped, three sided frame, and the attachment sleeves 30 and 30' form an attachment tube (not shown). The distal end 38 of the pole 16 is inserted into the tube. The bolt bore in the tube is aligned with the bolt apertures 34 and 34'. The fastening bolt 36 is placed through bolt aperture 34 of the first arm 12, and through the bolt bore in the tube until the bolt 36 extends beyond the aperture 34' of the second arm 14. The bolt 36 is held in place with a fastening cap 39.

A second method of attaching pole 16 to the arms 12,14 is shown in FIG. 3. A hollow liner cylinder 33 is secured to attachment sleeve 30 by rivets 32. Fastening bolt 36 is threaded along its entire length and sized to frictionally engage bolt aperture 34. An internally-threaded securing cap 39 screws onto the free end of the fastening bolt 36 and secures attachment sleeve 30 against attachment sleeve 30'. A pair of flexible spring arms 35, 35' is located within the liner cylinder 33. A hemispherical knob 37, 37' is disposed at the proximal end of each spring arm 35, 35', respectively. The distal end of spring arm 35 is attached to the distal end of spring arm 35'. These spring arms 35,35' are in a state of compression and bias the knobs 37,37' outward through knob apertures 41,41' respectively. To use this attachment method, the distal end 38 of pole 16 would be hollow. The inner diameter of the distal end 38 of the pole 16 would be sized to fit the outer wall of the liner cylinder 33. Furthermore, the distal end 38 of the pole 16 would include a pair of knob-accepting apertures, not shown, to accept the outwardly-biased knobs 37,37'. By temporarily compressing the knobs 37,37' inward, toward the center axis of the liner cylinder 33, the liner cylinder may be inserted into the distal end 38 of the pole 16. When the knobs 37,37' are released, the spring arms 35, 35' will bias the knobs 37,37' outward, so the knobs abut the inner wall of the distal end 38 of the pole 16. When the knobs 37,37' are aligned with knob-accepting apertures, not shown, the knobs will engage the knob-engaging apertures to temporarily secure the liner cylinder 33 inside the distal end 38 of pole 16. In addition to the spring arms 35,35' described above, other methods, including longitudinally-extending helixes, may be used to bias the knobs 41,41' outward.

Other attachment means may be used to attach pole 16 to the arms 12,14. One such additional attachment means would include threads on the distal end 38 of the pole 16 and the tube formed by attachment sleeves 30 and 30'.

Figure 4:
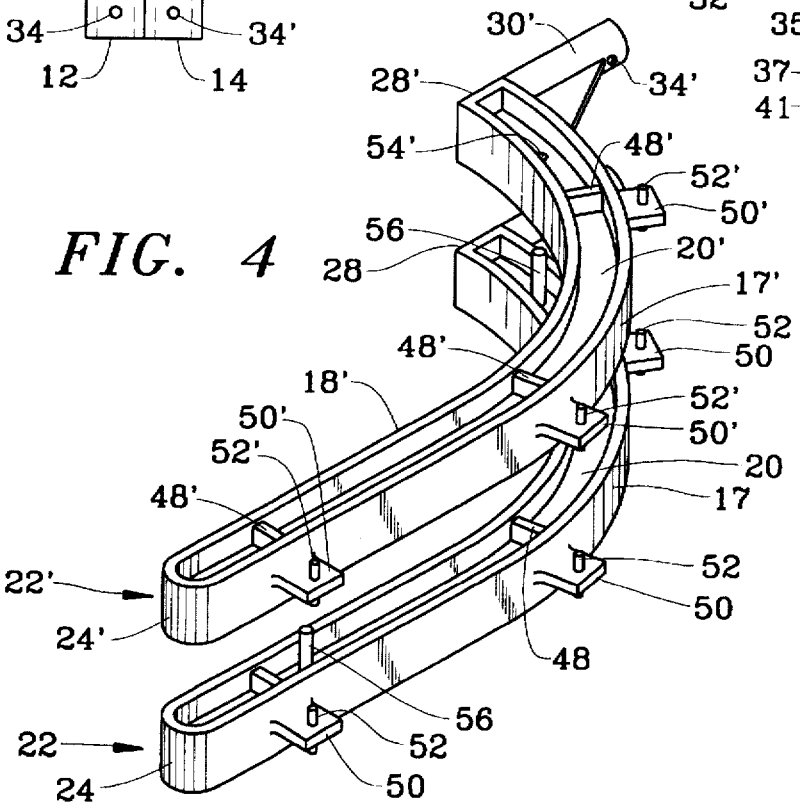
FIG. 4 is a perspective view of the arms of the present invention being placed into a stacked, storage position.

Referring now to FIGS. 3 and 4, the rigidity of the spreader arm 12 is increased by integral reinforcing braces 48, while the rigidity of the spreader arm 14 is increased by integral reinforcing braces 48'. The braces 48, 48' extend orthogonally between each inner wall 18, 18' and outer wall 17, 17' of the arms 12 and 14. The inner walls 18, 18', outer walls 17, 17', and reinforcing braces 48, 48' all have the same height. The first spreader arm 12 has three braces 48 extending orthogonally from the arm's spacing wall 20. The second spreader arm 14 has three braces 48' extending orthogonally from the arm's spacing wall 20'. While three such braces 48 and 48' are shown, any number of braces might be used as needed to increase the structural integrity of the device 10.

In addition to the attachment sleeve 30, the outer wall 17 of first spreader arm 12 also includes line-support tabs 50. More particularly, the outer wall 17 includes three line-support tabs 50 extending orthogonally therefrom. The outer wall 18' of the second spreader arm 14 also includes three line-support tabs 50' extending orthogonally therefrom. Retaining posts 52 and 52' extend orthogonally from each respective tab 50 and 50' on spreader arms 12 and 14.

Figure 5:
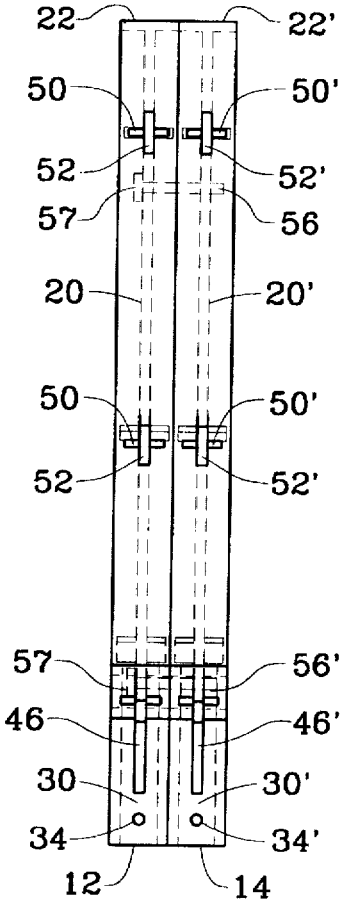
FIG. 5 is an elevation view of the arms of the present invention in a stacked, storage position.

Spacing wall 20 includes stacking apertures 54, and spacing wall 20' includes corresponding stacking apertures 54' for receiving the stacking posts or pins 56. These apertures 54, 54' aid in storing the device 10. Spacing wall 20 has two stacking apertures 54, while spacing wall 20' has two stacking apertures 54'. The stacking apertures 54, 54' are sized to frictionally engage a stacking pin 56. To store the device 10, the user withdraws the fastening bolt 36 from the bolt bore in the tube 16 and the bolt apertures 34, 34'. The spreader arms 12, 14 may then be removed from the pole 16. As shown in FIG. 5, the arms 12, 14 are then stacked, one on top of the other, with the stacking apertures 54 of the first arm 12 aligned with the stacking apertures 54' of the second arm 14. A stacking pin 56 is then inserted through each pair of corresponding stacking apertures 54, 54'. Because the stacking apertures are sized to frictionally engage the stacking pins 56, the arms are thus selectively secured in a stacked, storage orientation. A stopping plate 57 is located at one end of each stacking pin 56, to ensure proper placement of the stacking pin within the stacking aperture 54 or stacking aperture 54'. Since the pin 56 frictionally fits in the apertures 54, 54' of either arm 12, 14, the user may choose to leave the stacking pins in either arm during use for line handling. The pins 56 will thereby be available, without fear of losing them, when the arms 12, 14 are later stacked for storage purposes. Accordingly, stacking allows for compact storage of the device 10.

When using the device 10, as shown in FIGS. 1 and 2, the loop end 56 of a mooring line 58 is adjusted to be substantially the same size as the outer dimensions of the U-shaped frame formed by attaching the arms 12, 14 to the pole 16, as described above. The looped end 56 is then draped around the frame and placed against the line-support tabs 50. The retaining posts 52, 52' and outer walls 17, 17' of each arm 12, 14 cooperate to keep the loop in place. When a suitable piling or cleat 60 is within line-deployment range, the looped end 56 of the line 58 is placed around the piling or cleat 60. Once the piling or cleat 60 is located within the looped end 56 of the line 58, the device 10 is withdrawn from the piling or cleat 60. Upon withdrawal, the looped end 56 of the mooring line 58 engages the piling 60. The loop end 58 may then be tightened around the piling or cleat 60 by pulling on the non-looped end (not shown) of the mooring line 58. Once the looped end has been drawn tight, the line can then be secured to a boat, not shown, in the normal manner.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An apparatus for positioning a mooring or docking line, said apparatus comprising:

an extension pole having an elongated shaft with a distal end;

a two-piece line spreader structure defined by an arc-shaped first spreader arm having at least one line-support means projecting outwardly from an outer wall thereof and an arc-shaped second spreader arm having at least one line-support means projecting outwardly from an outer wall thereof, said second spreader arm forming a mirror image of said first spreader arm; and means for coupling said first spreader arm and said second spreader arm to said distal end of said pole;

whereby said spreader structure forms a U-shaped configuration upon coupling of said first and second spreader arms to said pole, wherein said spreader structure facilitates positioning of a mooring line by maintaining a line loop sized to encircle a piling.

2. The apparatus according to claim 1, wherein said first spreader arm includes a first sleeve that extends radially from said outer wall of said first spreader arm; and said second spreader arm includes a second sleeve that extends radially from said outer wall of said second spreader arm, said first and second sleeves each having an aperture placed perpendicularly therethrough, each of said apertures sized to receive a fastening bolt, whereby said fastening bolt couples said first and second support arms to said pole.

3. The apparatus according to claim 1, wherein said line-support means is defined as a plurality of tabs extending radially from said outer wall of each said spreader arm.

4. The apparatus according to claim 3, wherein each of said plurality of tabs includes at least one post that extends orthogonally from each of said tabs for use in engaging said line.

5. The apparatus according to claim 1, wherein said first and second spreader arms each include a plurality of apertures, said apertures sized to frictionally receive a stacking pin, said stacking pin extending orthogonally from one of said apertures in said first spreader arm and frictionally engaging a corresponding one of said apertures in said second spreader arm.

6. The apparatus according to claim 5, wherein said stacking pins are reversible, whereby said stacking pins extend orthogonally from said second spreader arm and frictionally engage corresponding said apertures in said first spreader arm.

7. The apparatus according to claim 1, wherein said spreader arms are constructed from polyethylene.

8. The apparatus of claim 1, wherein said apparatus floats.

9. An apparatus for positioning a mooring line, said apparatus comprising:

an extension pole having an elongated shaft with a distal end;

a two-piece spreader structure defined by an arc-shaped first spreader arm, said first spreader arm including a plurality of support tabs extending radially from an outer wall thereof, said second spreader arm including a plurality of support tabs extending radially from an outer wall thereof, said second spreader arm forming a mirror image of said first support arm;

coupling means for detachably coupling said first and second support arms to said distal end of said pole; and stacking means for superimposing said first support arm against said second support arm in a storage position;

whereby said spreader structure forms a U-shaped configuration upon coupling of said first and second spreader arms to said pole, wherein said spreader structure facilitates positioning of a mooring line by maintaining a line loop sized to encircle a piling.

10. The apparatus of claim 9, wherein said coupling means is defined by a first sleeve that extends radially from said outer wall of said first spreader arm; and a second sleeve that extends radially from said outer wall of said second spreader arm, said first and second sleeves each having an aperture placed perpendicular therethrough, each of said apertures sized to receive a fastening bolt, whereby said fastening bolt couples said first and second support arms to said pole.

11. The apparatus of claim 9, wherein said coupling means is defined by a first sleeve that extends radially from said outer wall of said first spreader arm; a second sleeve that extends radially from said outer wall of said second spreader arm, said first and second sleeves each having an aperture placed perpendicular therethrough, of said bolt apertures sized to receive a fastening bolt; a liner cylinder which is permanently secured to an inner surface of said first sleeve, said liner cylinder having a plurality of knob-engaging apertures; a first spring arm, a distal end of which is attached to a distal end of a second spring arm; a first knob attached to a proximal end of said first spring arm; a second knob attached to a proximal end of said second spring arm; and a fastening cap disposed on a distal end of said fastening bolt, whereby said first and second spring arms bias each of said knobs into one of said knob-accepting apertures, and said fastening bolt passes through said bolt apertures of said first and second sleeves, thereby securing said second sleeve to said liner cylinder.

12. The apparatus of claim 9, wherein said stacking means is defined by a plurality of apertures disposed in said first and second spreader arms, each of said plurality of apertures sized to frictionally receive a stacking pin, said stacking pin extending orthogonally from one of said apertures said first spreader arm and frictionally engaging a corresponding said aperture in said second spreader arm.

13. An apparatus for positioning a mooring or docking line, said apparatus comprising:

an extension pole having an elongated shaft;

a two-piece line spreader structure defined by an arc-shaped first spreader arm having at least one tab extending radially from an outer wall thereof, said at least one tab having at least one post that projects orthogonally from said tab for use in engaging said line and an arc-shaped second spreader arm having at least one tab extending radially from an outer wall thereof, said at least one tab having at least one post that projects orthogonally from said tab for use in engaging said line, said second spreader arm forming a mirror image of said first spreader arm;

coupling means to couple said first and second spreader arms to said pole, said coupling means defined by a first sleeve extending radially from said outer wall of said first spreader arm; and a second sleeve extending radially from said second spreader arm, each of said sleeves having an aperture placed perpendicular therethrough, said aperture sized to receive a fastening bolt; and stacking means for juxtaposing said first spreader arm against said second spreader arm, said stacking means defined by a plurality of apertures disposed in said first and second spreader arms, each of said plurality of apertures sized to frictionally receive a stacking pin, said stacking pin extending orthogonally from one of said apertures in said first spreader arm and frictionally engaging a corresponding said aperture in said second spreader arm;

whereby said spreader structure forms a U-shaped configuration upon coupling of said first and second spreader arms to said pole, and wherein said spreader structure facilitates the handling of a mooring line by maintaining a line loop sized to encircle a piling.

* * * * *